US008770085B2

(12) United States Patent
Sanborn et al.

(10) Patent No.: US 8,770,085 B2
(45) Date of Patent: Jul. 8, 2014

(54) APPARATUS, METHODS AND SYSTEM FOR IMPROVED LIGHTWEIGHT ARMOR PROTECTION

(75) Inventors: Steven L. Sanborn, Lapeer, MI (US); Lee Smathers, Bloomfield, MI (US); Wayne Burke, Birmingham, MI (US)

(73) Assignee: General Dynamics Land Systems, Inc., Sterling Heights, MI (US)

( * ) Notice: Subject to any disclaimer, the term of this patent is extended or adjusted under 35 U.S.C. 154(b) by 841 days.

(21) Appl. No.: 12/212,086

(22) Filed: Sep. 17, 2008

(65) Prior Publication Data

US 2011/0174143 A1 Jul. 21, 2011

Related U.S. Application Data

(60) Provisional application No. 60/975,839, filed on Sep. 28, 2007.

(51) Int. Cl.
*F41H 5/04* (2006.01)

(52) U.S. Cl.
USPC ..... 89/36.02; 89/904; 89/918

(58) Field of Classification Search
USPC ..... 89/36.01–36.08, 36.11, 36.12, 36.15, 89/903, 904, 910, 918, 920, 36.09; 2/2.5; 428/848.5, 566
See application file for complete search history.

(56) References Cited

U.S. PATENT DOCUMENTS

| | | | | |
|---|---|---|---|---|
| 1,290,799 | A | | 1/1919 | Talley |
| 1,513,766 | A | | 11/1924 | Spooner |
| 1,739,112 | A | | 12/1929 | Wisbrod |
| 3,179,553 | A | | 4/1965 | Franklin |
| 3,563,836 | A | | 2/1971 | Dunbar |
| 3,813,281 | A | | 5/1974 | Burgess et al. |
| 3,829,899 | A | | 8/1974 | Davis |
| 3,867,239 | A | | 2/1975 | Alesi et al. |
| 3,962,976 | A | | 6/1976 | Kelsey |
| 3,977,294 | A | | 8/1976 | Jahn |
| 4,292,375 | A | * | 9/1981 | Ko ..... 428/593 |
| 4,307,140 | A | | 12/1981 | Davis |
| 4,323,000 | A | | 4/1982 | Dennis et al. |
| 4,476,660 | A | * | 10/1984 | Francovitch ..... 52/515 |

(Continued)

OTHER PUBLICATIONS

Israel Patent Office, Office Action for Israeli Patent Application No. 204626, mailed Jun. 13, 2013.

*Primary Examiner* — Reginald Tillman, Jr.
(74) *Attorney, Agent, or Firm* — Ingrassia Fisher & Lorenz P.C.

(57) ABSTRACT

An apparatus, method and system to enhance the performance of composite armor by utilizing the energy of the threat projectile is disclosed. The frontal member includes, for example, a plurality of concentric proves on the face opposite of the surface that is impacted by a projectile. The grooves in the frontal member preferably may mate with a complimentary plurality of concentric grooves in a backing plate. During impact by a projectile, the force from the projectile presses the grooves of the frontal member into engagement with the grooves of the backing plate. The grooves are uniquely designed to cause the backing plate to impart a compressive load into the backside of the frontal member preventing it from prematurely fracturing in tension at the onset of the projectile penetration. In accordance with the preferred embodiment of the frontal member grooves, the angles of the each concentric groove are individually selected to cause the groove induced compressive loads to match the frontal member tensile loads from the penetrating projectile. The structural integrity of the frontal member is thus maintained until the projectile is defeated.

19 Claims, 4 Drawing Sheets

(56) References Cited

U.S. PATENT DOCUMENTS

| | | | | |
|---|---|---|---|---|
| 4,633,756 | A | 1/1987 | Rudoi | |
| 4,648,136 | A | 3/1987 | Higuchi | |
| 4,739,690 | A | 4/1988 | Moskowitz | |
| 4,744,187 | A * | 5/1988 | Tripp | 52/410 |
| 4,868,040 | A | 9/1989 | Hallal et al. | |
| 4,895,063 | A | 1/1990 | Marlow et al. | |
| 4,911,061 | A | 3/1990 | Pivitt et al. | |
| 4,928,575 | A | 5/1990 | Smirlock et al. | |
| 4,945,814 | A | 8/1990 | Huet | |
| 4,948,673 | A | 8/1990 | Goeury | |
| 4,953,442 | A | 9/1990 | Bartuski | |
| 4,965,138 | A * | 10/1990 | Gonzalez | 428/593 |
| 4,987,033 | A | 1/1991 | Abkowitz et al. | |
| 5,014,592 | A | 5/1991 | Zweig | |
| 5,164,536 | A | 11/1992 | Barbaza et al. | |
| 5,170,690 | A | 12/1992 | Smirlock et al. | |
| 5,191,166 | A | 3/1993 | Smirlock et al. | |
| 5,196,252 | A | 3/1993 | Harpell | |
| 5,200,256 | A | 4/1993 | Dunbar | |
| 5,254,383 | A | 10/1993 | Harpell et al. | |
| 5,326,606 | A | 7/1994 | Labock | |
| 5,333,532 | A | 8/1994 | Smirlock et al. | |
| 5,361,678 | A | 11/1994 | Roopchand et al. | |
| 5,402,703 | A | 4/1995 | Drotleff | |
| 5,469,773 | A | 11/1995 | Tarpinian | |
| 5,480,706 | A | 1/1996 | Li et al. | |
| 5,515,541 | A | 5/1996 | Sacks et al. | |
| 5,560,971 | A | 10/1996 | Emery | |
| 5,635,288 | A | 6/1997 | Park | |
| 5,686,689 | A | 11/1997 | Snedeker et al. | |
| 5,705,764 | A | 1/1998 | Schade et al. | |
| 5,738,925 | A | 4/1998 | Chaput | |
| 5,763,813 | A | 6/1998 | Cohen et al. | |
| 5,824,940 | A | 10/1998 | Chediak et al. | |
| 5,970,843 | A | 10/1999 | Strasser et al. | |
| 5,972,819 | A | 10/1999 | Cohen | |
| 5,996,115 | A | 12/1999 | Mazelsky | |
| 6,035,438 | A | 3/2000 | Neal et al. | |
| 6,112,635 | A | 9/2000 | Cohen | |
| 6,116,328 | A | 9/2000 | Karmarkar et al. | |
| 6,135,006 | A | 10/2000 | Strasser et al. | |
| 6,203,908 | B1 | 3/2001 | Cohen | |
| 6,216,579 | B1 | 4/2001 | Boos et al. | |
| 6,289,781 | B1 | 9/2001 | Cohen | |
| 6,314,858 | B1 | 11/2001 | Strasser et al. | |
| 6,408,733 | B1 | 6/2002 | Perciballi | |
| 6,408,734 | B1 | 6/2002 | Cohen | |
| 6,418,832 | B1 * | 7/2002 | Colvin | 89/36.02 |
| 6,510,777 | B2 | 1/2003 | Neal | |
| 6,532,857 | B1 | 3/2003 | Shih et al. | |
| 6,575,075 | B2 | 6/2003 | Cohen | |
| 6,703,104 | B1 | 3/2004 | Neal | |
| 6,826,996 | B2 | 12/2004 | Strait | |
| 6,895,851 | B1 | 5/2005 | Adams et al. | |
| 6,912,944 | B2 | 7/2005 | Lucuta et al. | |
| 6,920,817 | B2 | 7/2005 | Ravid et al. | |
| 6,955,112 | B1 | 10/2005 | Adams et al. | |
| 7,067,031 | B2 | 6/2006 | deWitt | |
| 7,069,836 | B1 | 7/2006 | Palicka et al. | |
| 7,117,780 | B2 | 10/2006 | Cohen | |
| 2001/0032541 | A1 | 10/2001 | Benyami et al. | |
| 2002/0012768 | A1 | 1/2002 | Cohen | |
| 2003/0110932 | A1 | 6/2003 | Mohr et al. | |
| 2003/0167910 | A1 | 9/2003 | Strait | |
| 2003/0192426 | A1 | 10/2003 | Peretz | |
| 2003/0200861 | A1 | 10/2003 | Cordova et al. | |
| 2004/0020354 | A1 | 2/2004 | Ravid et al. | |
| 2004/0066082 | A1 | 4/2004 | Mears et al. | |
| 2004/0083880 | A1 | 5/2004 | Cohen | |
| 2004/0197542 | A1 | 10/2004 | Benitsch | |
| 2004/0216595 | A1 | 11/2004 | Dickson | |
| 2005/0066805 | A1 | 3/2005 | Park et al. | |
| 2005/0072294 | A1 | 4/2005 | Cohen | |
| 2005/0172792 | A1 | 8/2005 | Wolf et al. | |
| 2005/0197020 | A1 | 9/2005 | Park et al. | |
| 2006/0013977 | A1 | 1/2006 | Duke et al. | |
| 2006/0027089 | A1 | 2/2006 | Cordova et al. | |
| 2006/0030226 | A1 | 2/2006 | Park et al. | |
| 2006/0065111 | A1 | 3/2006 | Henry | |
| 2006/0102276 | A1 | 5/2006 | deWitt | |
| 2006/0105183 | A1 | 5/2006 | Chu et al. | |
| 2006/0105184 | A1 | 5/2006 | Palicka et al. | |
| 2006/0137517 | A1 | 6/2006 | Palicka et al. | |
| 2006/0141237 | A1 | 6/2006 | Leighton | |
| 2006/0169128 | A1 | 8/2006 | Aghajanian et al. | |
| 2006/0201318 | A1 | 9/2006 | LaBrash et al. | |
| 2006/0213360 | A1 | 9/2006 | Ravid et al. | |
| 2006/0243127 | A1 | 11/2006 | Cohen | |
| 2006/0269765 | A1 | 11/2006 | Collier et al. | |

* cited by examiner

APPARATUS, METHODS AND SYSTEM FOR IMPROVED LIGHTWEIGHT ARMOR PROTECTION

RELATED APPLICATIONS

This application is related to and claims the benefit under 35 U.S.C. §119 of U.S. provisional application Ser. No. 60/975,839, entitled "Apparatus, Methods, and System for Improved Lightweight Armor Protection," filed on Sep. 28, 2007, which is incorporated herein by reference in its entirety.

TECHNICAL FIELD AND BACKGROUND OF THE INVENTION

This invention relates to an armor structure, system, and method of providing armor.

Armor structures may be used to provide protection from projectiles that would impact vehicles, buildings, and personnel. In this context, vehicles could include ground vehicles, ships, submarines, aircraft, or spacecraft. The armor structures are often provided as a component in a laminate that comprises an armor system. The frontal member of the composite is typically present to fracture and erode impacting projectiles. A backing plate or fabric liner behind the frontal member structurally supports the frontal member and then captures the residual projectile and armor fragments.

The ceramics that are typically used in armor structures are useful materials for defeating projectiles as long as they operate in a compressive mode. For example, the compressive strength of silicon carbide (SiC) ceramic is 3,900 Mega Pascals (566,000 psi); yet the tensile strength is only 380 Mega Pascals (55,000 psi). The ratio of compressive strength to tensile strength for most metals is approximately 1 to 1, but for armor ceramics the compressive to tensile strength ratio ranges from 10 to 1 when tested in a quasi static mode to 20 to 1 when tested under dynamic conditions such as ballistic impact.

Armor is becoming an ever increasing burden to host vehicles, buildings, or personnel. This burden includes the increase in weight; the increase in space; and the cost imposed by the armor. This increasing burden is commensurate with the ever increasing threats and increasing lethality of modern projectiles.

The most common ceramic material used as armor is alumina oxide. In recent years, ceramics that are lighter than alumina oxides have been developed as armor. Newer ceramics include, but are not limited to, aluminum nitride, silicon carbide, and boron carbide. Unfortunately these newer lighter ceramics are significantly more expensive than alumina oxide.

Research has continued to develop improved grades of ceramic materials tailored to meet requirements for armored systems with the general understanding that ceramic materials that are harder and have greater fracture toughness generally perform better as armors.

Other techniques to harden a ceramic armor material have encapsulated the ceramic in a preloaded state. The preload is provided by a compressive surrounding frame, usually made of metal. The frame also holds a fractured ceramic armor in place preventing the projectile from pushing it aside and penetrating into the host object. Encapsulation of ceramic armor is a costly technique that carries several integration challenges when the design is moved from the laboratory to the host vehicle.

The armor industry measures the performance of armor with a scoring system called "mass efficiency." Every projectile can be stopped by a certain amount of armor steel. In the armor industry, the particular alloy of steel used as the performance standard is designated Rolled Homogeneous Armor (RHA). It is a specific alloy and temper of steel defined in the US Military Standard MIL-STD-12560. The mass efficiency, designated $E_m$, is the weight per unit area of RHA required to stop a particular threat projectile divided by the weight per unit area of the candidate armor to stop the same threat. RHA armor has an $E_m$ of 1. Some ceramic armor laminates may demonstrate better mass efficiencies against Armor Piercing (AP) projectiles than steel.

Due to weight constraints, the payload of armored vehicles is typically reduced with the addition of increased armor. Vehicle payload will continue to decrease, or the overall weight of the vehicle will have to increase, unless armor systems can be developed with significantly improved performance; with higher mass efficiencies.

SUMMARY OF INVENTION

This invention relates to, for example, an armor structure, system, and method of providing armor that utilizes the kinetic energy of the projectile as part of the defeat mechanism.

Various aspects and embodiments of the present invention, as described in more detail and by example below, address certain of the shortfalls of the background technology and emerging needs in the relevant field.

The present invention includes an apparatus, method, and system for providing lightweight armor protection. In a preferred embodiment, the invention includes an integral compression-inducing backing plate and a frontal member which may be configured in a way to interact with each other to delay tensile fracture in, for example, a ceramic or glass component incorporated as the frontal member to defeat an incident projectile.

This invention includes, for example, a design intended to control the tensile stress of a frontal member from its rear face; thus extending the time that the defeat mechanism acts to absorb the energy of an incident projectile.

The present invention disclosed herein is described in several structural embodiments. In one such embodiment of this invention, the frontal member is profiled with a plurality of grooves on the face opposite of the surface that, in a preferred embodiment, mate with a complimentary plurality of receiving channels in a backing plate. The grooves and channels may be concentric, i.e., share a common center.

During impact by a projectile, the force from the projectile may, in a preferred embodiment, press the outer surfaces of the grooves of the frontal member in engagement with the inner surfaces of the receiving channels of the backing plate. The grooves and corresponding channels are preferably uniquely designed to cause the backing plate to impart a compressive load into the backside of the frontal member, thereby preventing it from prematurely fracturing in tension at the onset of projectile penetration. In accordance with a preferred embodiment of the frontal member grooves, the angles of each groove are individually selected to cause the groove induced compressive loads to match the tensile loads induced by the penetrating projectile. The structural integrity of the armor material is thus maintained until the projectile is defeated.

The backing plate of an embodiment of the present invention may function as a means to induce compressive stress into the frontal member. These induced compressive stresses from, for example, the inclusion of grooves and corresponding channels, offset the tensile stresses that may typically lead to fracture of a ceramic armor material. As the force of the projectile is exerted onto the front face of the frontal member, the grooves on the back face of the frontal are forced into the corresponding channels of the backing plate; as the grooves are forced into the corresponding channels, the angled channel walls impart a compressive force onto the grooves and frontal member.

A further feature in a preferred embodiment of the invention is to use a host structure as the backing plate. This may, for example, include manufacturing grooves or channels on the exterior of the host surface to mate with the backside of the frontal member of the armor. The host may, for example, include an aircraft, watercraft, spacecraft, garment worn by a person or animal, or a building, but may also include other objects. The effect of this embodiment is to use the backing plate synergistically as a structural element of the host, thus reducing the parasitic burden of the armor and further increasing the mass efficiency of the overall system.

According to still further features in a described preferred embodiment of this invention, finite element models of the invention show that concentric grooves can effectively disrupt the reflected shock waves that initiate internal cracks in the frontal member. Designs including non-concentric grooves may be used, however, and preferable in certain embodiments.

According to still further features in a preferred embodiment of this invention, concentric grooves significantly increase a glue surface between the frontal member and the backing plate, thus increasing the durability of the frontal members and its resistance to being dislodged when operating in the environment characteristic to off-road armored combat vehicles.

According to still further features in an embodiment of this invention the incident angle of the surfaces of the grooves and channels can, for example, be optimized so that the surface angles at each groove-channel interface from the inner groove set to the outer groove set increase at a rate proportional to the amount of total compression to be achieved on the backside of the frontal member. The angles and spacing of the grooves and corresponding channels can appear to be approximately similar to the profile defined by the French scientist Augustin Fresnel for the control of light through a planar lens. The determination of the incident angles of the surfaces to optimize the compressive loads, however, is different than simply calculating the focal length for a Fresnel lens. The lens segments of a Fresnel lens are, for example, spherical arcs or portions of arcs about a common center. The lens segments accordion to a common plane, providing a thin, compact optical element. The present invention may exploit the "structural" advantage of the Fresnel spherical segments causing the frontal member and backing plate to respond as a series of domes, bonded together, with each dome portion of the frontal member transferring a portion of the projectile load to the dome portions of the backing plate. As the projectile causes an incident loading onto the frontal member, dome portions of the frontal member compress against the dome members of the backing plate and the backside of the frontal member enters a compressive condition in a direction that is orthogonal to the loading of the incident projectile. It is to be understood, of course, that the spherical arcs and series of domes that are used in Fresnel lens design are not necessary for the design of armor and inclined planes and other surface shapes, such as, for example inclined or flat planes and/or parabolas, may be used to create the Fresnel-like structure.

According to still further features in an embodiment of this invention, the encapsulating frame may be omitted from around the perimeter of the armor structure, as was often required in the prior art. Given this new mechanism to compress the frontal member through the interaction with the backing plate, armor structures can, for example, be efficiently nested together to provide continuous coverage over the surface of a vehicle without the parasitic burden of a frame characteristic of encapsulated armor.

According to still further features in an embodiment of this invention, compressive preload of the frontal member can, for example, be achieved prior to the impact by the threat projectile. One method of achieving this optional preload is by applying pressure to the frontal member in the direction towards the backing plate while adhesive between the frontal member and backing plate is curing. The prior art method of preloading ceramic armor within a steel frame may also be used in embodiments of this invention alone or in combination with the aforementioned preload pressure-applying method. The amplitude of the compression provided may be significantly larger than encapsulated ceramic armors because the magnitude is proportional to the loading from the pressure of the projectile. Under static conditions such compressive loading as generated by projectile pressure on the teeth would likely fracture the ceramic. In a dynamic impact condition, the projectile may also induce a collection of tensile stresses that superimpose one another. The compressive and tensile stresses can be offset by selecting the appropriate contact angle on the grooves. The compressive preload on the frontal member is generally proportional to the load from the projectile and the angle of the groove. Analysis has shown that the compressive preload is relatively constant during the penetration process. The induced tensile loads are, however, time dependant and are a superimposed collection of Hertzian contact stresses, plate (membrane and bending) stresses, shock wave induced stresses, and Hydrostatic stresses (from the projectile embedding in the comminuted frontal member).

According to still further features in a described embodiment of this invention this invention is not limited to a particular ceramic or glass and the discussion herein should not be interpreted to limit the invention to the use of ceramic or glass. Other equivalent materials may be selected based upon their known or discovered material characteristics.

The present invention, for example, significantly improves upon the performance of conventional laminated or encapsulated ceramics, but is not limited to ceramic applications. Certain ceramics include, but are not limited to aluminum nitride, silicon carbide, and boron carbide. The higher performance ceramics will, of course, perform better, but will also be more expensive. The present invention achieves improved results using less expensive materials such as alumina oxide and, therefore, in certain embodiments this less expensive material may be preferred for cost reasons rather than ultimate performance.

According to still further features in an embodiment of this invention, when the thickness of the frontal member and backing plate are optimized to minimize weight and/or cost, the deflection of the backing plate after the projectile has been defeated is minimal. The projectile may be almost entirely defeated by the ceramic configured in accordance with the present invention. Various embodiments of the present invention are appropriately suited for body armor or for vehicles where deflection of the outer shell during ballistic impact must be minimized.

According to still further features in a described embodiment of this invention, the addition of a cover plate provides an environmental cover over the frontal member. The cover may also cause the penetration resistance to the projectile to increase, thus causing the mass efficiency to further increase. This feature, as with others described herein, is optional.

According to still further features in a described embodiment of this invention, the damage or destruction of a tile by a projectile may be limited to the tile of impact. Adjacent tiles may be minimally affected and damage repairable in situ.

According to still further features of embodiments of this invention, armor structures may be configured as adapted to be removed and upgraded or changed depending on the anticipated threat or as a result of a product improvement. The armor can, for example, be configured as a single integrated tile having a frontal member, a cover, and a backing. In a typical embodiment, well suited for vehicle retrofit, the profile of the backing may be the same as the frontal member. The frontal member with integral backing system may present a self-contained or pre-assembled package that can be tiled (e.g., glued or otherwise uniformly or selectively affixed) over an existing vehicle surface to provide increased armor protection.

BRIEF DESCRIPTION OF DRAWINGS

The accompanying drawings, which are included to provide a further understanding of the invention and are incorporated in and constitute a part of this specification, illustrate exemplary embodiments of the invention that together with the description serve to explain, but not limit, the principles of the invention in the drawings.

DETAILED DESCRIPTION OF PREFERRED EMBODIMENTS

It is to be understood that the present invention is not limited to the particular methodology, compounds, materials, manufacturing techniques, uses, and applications described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements, and includes equivalents thereof known to those skilled in the art. Similarly, for another example, a reference to "a step" or "a means" is a reference to one or more steps or means and may include sub-steps or subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices and materials are described although any methods, techniques, devices, or materials similar or equivalent to those described may be used in the practice or testing of the present invention. Structures described herein are to be understood also to refer to functional equivalents of such structures.

Figure 1:
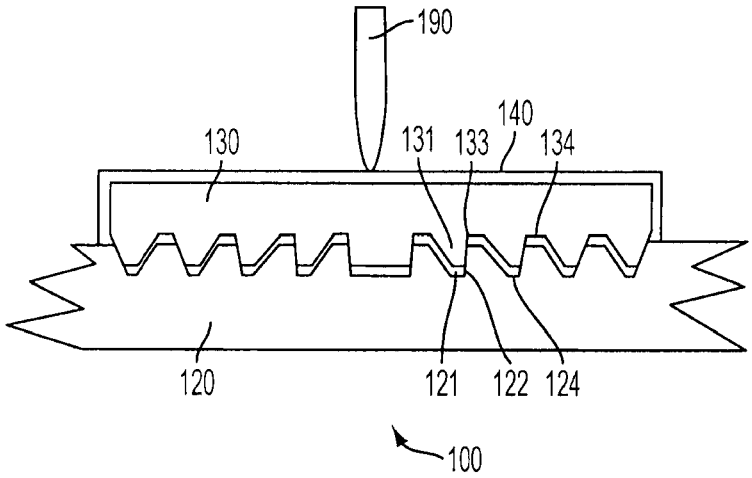
FIG. 1 is a cross-section of an embodiment of the present invention.

In FIG. 1, a cross section of an integrated armor structure 100 according to one embodiment is presented. It can be seen that integrated armor structure 100 has two major components: the frontal member 130 and the backing plate 120. The front face of backing plate 120 contains a plurality of receiving channels 121 while the back face of frontal member 130 contains a plurality of grooves 131 that correspond to said receiving channels. It can be seen that the outer surface 132 of the grooves 131 of the frontal member 130 rests against the inner surface 122 of the corresponding receiving channels 121 of the backing plate 120. The height of each groove is preferably less than the depth of the corresponding receiving channel such that the grooves do not contact the channel base 124 (i.e., they do not bottom out). Each groove is affixed to the back face of the frontal member 130 at the groove root 134. An optional cover plate 140 may be disposed onto, for example, the front face of the frontal member 130. In this embodiment, cover plate 140 may be first impacted by the projectile 190 before impacting the frontal member 130. Having cover plate 140 may improve the strength of the overall armor structure, but also may serve the purpose of sealing the armor structure from environmental conditions, such as moisture or fire, which may weaken one or more of the armor structure components. In certain embodiments, the outer surface of the cover plate and/or the frontal member may be rounded or angled in a convex or concave manner so that the incident force of the projectile may be directed.

It is preferred, but not required, that the shear strength of the backing plate be similar to or greater than the shear strength of the frontal member to insure that the frontal member performs at its maximum potential, thereby achieving the lightest armor system possible. It is also preferred, but not required, that the intersecting angles at each groove root 134 and channel base 124 be rounded (fillet) to the maximum attainable radius so as to minimize the local stress concentration factor.

Figure 2:
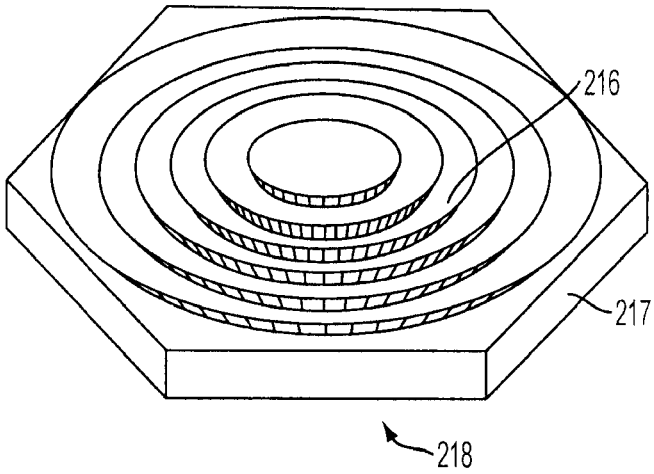
FIG. 2 is a three-dimensional perspective illustration of a hexagonal frontal member of an embodiment of the present invention.

As depicted, for example in FIG. 2, a frontal member 217 is illustrated with the back face directed upward. The grooves 216 are shown in this embodiment to be circular and manufactured directly into the hexagonal ceramic tile 218. The tile 218 is shown as hexagonal as an example but is not limited to a specific shape. The grooves 216 are not limited to a round configuration.

Figure 3:
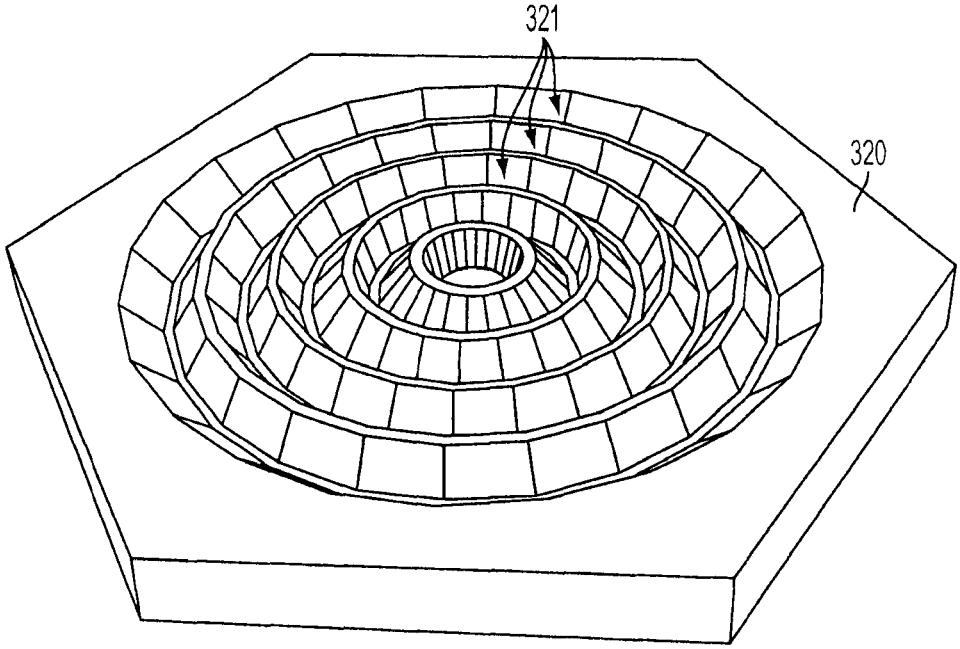
FIG. 3 is a three-dimensional perspective illustration of a hexagonal backing plate of an embodiment of the present invention.

As depicted in another embodiment, for example, in FIG. 3, backing plate 320, depicted with the front face directed upward, is formed into a ceramic tile having a hexagonal perimeter. A plurality of receiving channels 321 are formed within the plate—in this case being concentric circles. The backing plate 320 is shown as hexagonal as an example but is not limited to any specific shape. Similarly, the receiving channels 321 are not limited to a round configuration.

Figure 4:
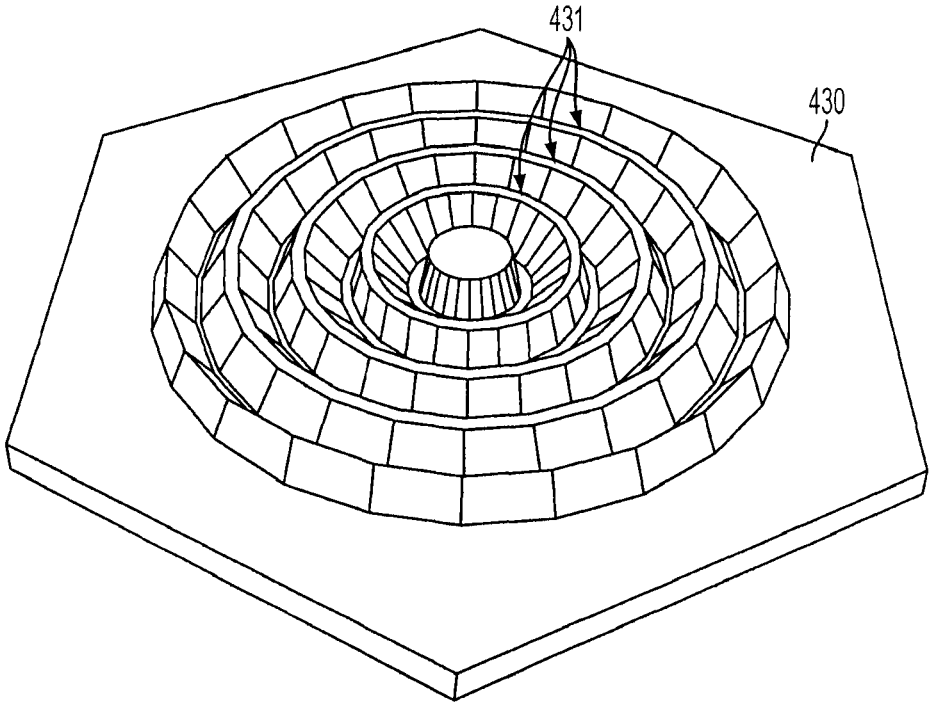
FIG. 4 is a three-dimensional perspective illustration of a hexagonal frontal member of an embodiment of the present invention.

In FIG. 4, another frontal member 430 is depicted with the back face directed upward and formed from a ceramic tile having a hexagonal perimeter. A plurality of grooves 431 are shown in this embodiment to be circular and manufactured directly into the plate. The frontal member 430 is shown as hexagonal as an example but is not limited to a specific shape. The grooves 431 are not limited to a round configuration.

Figure 5:
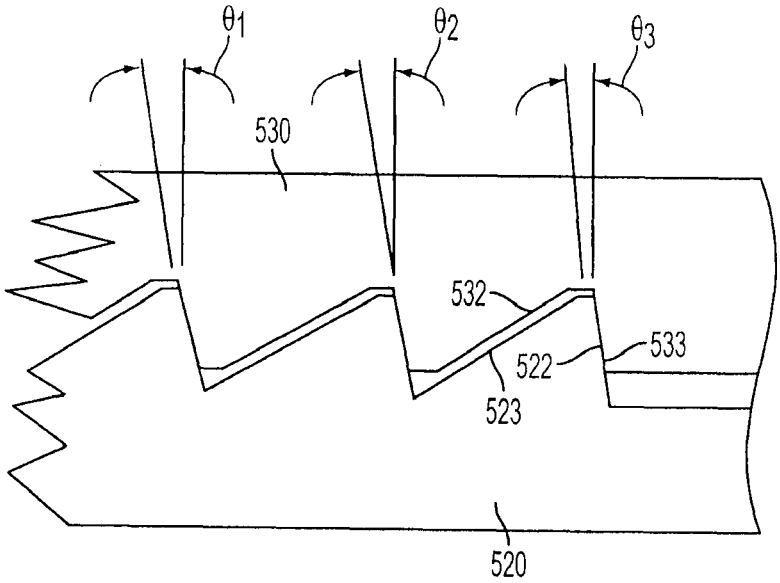
FIG. 5 is a cross-section through the grooves of an embodiment of the present invention.

FIG. 5 depicts an embodiment of the present invention wherein the angle of the outer surfaces 533 of the grooves on the frontal member 530 are about the same as the angle of the inner surfaces 522 of the corresponding channels on the backing plate 520. These two surfaces may be referred to as the "interfacing surfaces." Optimal conditions are expected to be achieved when the angles of the interfacing surfaces increase from the center of the armor structure to the outer perimeter. As depicted in the embodiment of FIG. 5, $\theta_1$ is greater than $\theta_2$ which in turn is greater than $\theta_3$. The angles of the outer surfaces of the grooves and corresponding inner surfaces of the channels preferably do not come into contact and are referred to as the "non-interfacing surfaces." The non-interfacing surfaces are preferably perpendicular to the angle of the interfacing surface to maximize the buttressing material behind the interfacing surfaces (thereby increasing the strength of the armor) but, depending on the application, may be more or less.

The angles of the interfacing surfaces are preferably in the range of five degrees to twenty degrees, but other angles may be used to accommodate for certain properties of the materials used for the armor as well as to accommodate for a predetermined threat. Also, the surface angle may increase at a rate anywhere from one to five degrees per groove, extending out from the center. The rate of increase of the incident angle may depend upon, for example, the distance between grooves, the number of grooves (preferably four to five per armor structure), the strength properties of the material used for the frontal member, cover plate, and backing plate, and the predetermined strength, density, and velocity of the projectile to be defeated. The determination of the angles of the interfacing and non-interfacing surfaces may be related to, but is by no means limited by, the calculations used in determining the focal length of a Fresnel lens, and the number of grooves (pitch).

Testing and modeling of certain embodiments of the present invention resulted in the defeat of projectiles introduced into the armor system, resulting in the velocity of the projectile being entirely reduced to zero. Although the frontal member was ultimately fractured by the projectile, the support backing showed very little deflection and had no penetration.

The grooves in the back of an embodiment of the frontal member limit the damage zone in the armor plate that is expected to be impacted by the projectile and also protects adjacent armor plates from damage. The overall effect is to, for example, enhance multi-hit capability.

The present invention thus provides a lightweight armor to provide protection from projectiles that would impact vehicles, buildings, and personnel. Projectiles can include, but are not limited to, bullets, shrapnel, shotgun pellets, fragments, exploding devices, explosive formed projectiles, or, in the case of spacecraft, meteorites. In turn, exploding devices can include, but are not limited to, pipe bombs, hand grenades, and Improvised Explosive Devices (IED).

Specifically, the present invention can provide a complete or partial protective shield over the host carrier. On any given host installation, the arrangement or construction of the present invention can vary depending on the desired protection level, the composition of the local host structure or anticipated attack angle of the threat projectile.

The present invention is not limited to the details set forth in the illustrations and drawings herein. Thickness of the frontal member, cover thickness, and backing thickness may be optimized to defeat a predetermined threat. The illustrated shape of the tile in FIG. 2 is exemplified as a hexagon though the invention does not, for example, limit the number of facets.

The shape of geometric features of the frontal member and backing plate, such as the teeth (e.g., groove and channel surfaces), the depth of these teeth, and the number of teeth should be selected to optimize the predicted projectile loading, the type of material selected for the frontal member, and the material of the backing plate. Shorter teeth tend to be more structurally robust, but have been found to require tighter manufacturing tolerances. Providing, for example, a generous radii at the root of the grooves and base of the channels is a good engineering practice as one example to enhance the structural capacity of at least one embodiment of the invention.

The pattern of the grooves may be concentric patterns of circles, triangles, squares, pentagons, hexagons, octagons, or other polygons, depending on the application of the tiles and, possibly, the particular surface shape of the host carrier. "Concentric," for purposes of this disclosure, is understood to mean any shape with a common center and is not limited to items that are circular or round. Additionally, other embodiments of this invention may employ non-concentric patterns. Similarly, the shape of the armor structure may take on any of the above-mentioned geometries as well.

The adhesive that may be included to retain the frontal member to the backing plate is optional. An embodiment of this invention could include a configuration where the cover plate held the frontal member in place without the need of an adhesive. Also, a steel frame may hold together the frontal member and backing plate at the outer perimeters. Other embodiments have the frontal member and backing plate connected by one or more bolts.

The material of the backing plate can be made, for example, of metal or polymer. Analysis has shown that high strength aluminum provides a weight effective solution. In the case where a different material has been selected for the host vehicle structure, an optimal embodiment of the present invention may be a frontal member mounted to an independent backing plate which in turn can be attached to the host vehicle.

A method of providing armor protection is also provided. For example, a compressive preload into the backside of the frontal member may be tailored to the material by selecting the angle of grooves that are in contact with the backing plate. The grooved profile on the back face of the frontal member also disrupts the shock wave initiated by the projectile impact preventing constructive build. The compressive preload in the frontal member during initial projectile impact and subsequent projectile impacts is adapted to be independent of adjacent tile history or physical damaged condition. Providing various groove patterns enhances performance of all materials used as a high hard surface that demonstrates ceramic-like properties (high ratio of compressive to tensile strength).

Embodiments of the invention adapted for protecting personnel such as body armor will likely include a backing plate because there is no inherent external substructure in a human. There are many schemes to retain armor laminates in bullet proof vests that would be able to exploit the benefit of the present invention.

This invention has been described herein in several embodiments. It is evident that there are many alternatives and variations that can embrace the performance of ceramics enhanced by the present invention in its various embodiments without departing from the intended spirit and scope thereof. The embodiments described above are exemplary only. One skilled in the art may recognize variations from the embodiments specifically described here, which are intended to be within the scope of this disclosure. As such, the invention is limited only by the following claims. Thus it is intended that the present invention cover the modifications of this invention provided they come within the scope of the appended claims and their equivalents.

What is claimed is:

1. Composite armor, comprising:

a frontal member having a strike face and a second face opposite the strike face, said second face comprising a plurality of continuous and concentric grooves, the plurality of continuous and concentric grooves each having a height; and a backing plate with a complimentary plurality of corresponding substantially continuous and concentric channels configured to contact the grooves of the frontal member, the substantially continuous and concentric channels of the backing plate each having a depth, with the height of at least one groove of the plurality of continuous and concentric grooves less than the depth of at least one corresponding channel of the plurality of substantially continuous and concentric channels so that the at least one groove does not contact a bottom surface of the at least one corresponding channel;

wherein said composite armor protects a host carrier from the impact of a projectile.

2. The composite armor of claim 1, wherein said backing plate comprises a polymer.

3. The composite armor of claim 1, wherein said backing plate comprises a metal.

4. The composite armor of claim 1, further comprising a cover plate defining a strike surface over said frontal member.

5. The composite armor of claim 4, wherein said strike surface comprises a material selected from the group of polymers or metals.

6. The composite armor of claim 1, further comprising an adhesive bond between the frontal member and backing plate.

7. An armor structure comprising:

a backing plate comprising a thickness, said backing plate comprising a plurality of concentric receiving channels, each of said receiving channels comprising:

a depth, an inner surface inclined at an incident angle, and an outer surface inclined at an incident angle; and a frontal member comprising a thickness, a front surface, and a back surface, said back surface disposed on said backing plate and said back surface comprising a plurality of concentric grooves that extend substantially uninterrupted about the back surface of the frontal member, and at least one of the plurality of grooves of said frontal member corresponds to at least one of the plurality of receiving channels of said backing plate, each of said grooves comprising:

a height, with the height of at least one groove less than the depth of at least one corresponding receiving channel so that the at least one groove does not contact a bottom surface of the at least one corresponding receiving channel, an inner surface inclined at an incident angle, and an outer surface, inclined at an incident angle;

wherein said armor structure protects from the impact of a projectile.

8. The armor structure of claim 7, wherein the radius of at least one groove is less than the radius of said corresponding at least one receiving channel.

9. The armor structure of claim 7, wherein at least one of said outer surfaces of at least one of said grooves is in contact with at least one of said inner surfaces of at least one of said receiving channels.

10. The armor structure of claim 7, whereby the incident angle of the inclined surface of the outer surface of each of said grooves is about the same as the incident angle of the inclined surface of the inner surface of each of said receiving channels aligned to receive the respective groove.

11. The armor structure of claim 7 wherein the pattern of said concentric grooves and receiving channels is selected from the following patterns: circles, ellipses, and polygons.

12. The armor structure of claim 7 wherein said backing plate comprises a material selected from the group of polymer, metal, or a polymer-metal composite.

13. The armor structure of claim 12 wherein said backing plate is made of high strength aluminum.

14. The armor structure of claim 7 further comprising a cover plate disposed upon the front surface of said frontal member, said cover plate defining a strike surface.

15. The armor structure of claim 14 wherein said strike surface comprises a material selected from the group of polymer or metal.

16. The armor structure of claim 7 further comprising an adhesive bond between said frontal member and said backing plate.

17. The armor structure of claim 7 wherein a plurality of said armor structures are disposed upon a host carrier, thereby providing at least a partial protective shield over said host carrier.

18. The armor structures of claim 17 wherein said armor structures are disposed upon a host carrier such that at least one armor structure is disposed upon a host carrier in a way that it may be removed without destroying adjacent parts.

19. A method of providing armor protection for defeating projectiles to a host carrier comprising:

forming a backing plate, said backing plate having a thickness and comprising a plurality of concentric receiving channels, each of said receiving channels having a depth, an inner surface, and an outer surface inclined at an incident angle;

forming a frontal member, said frontal member having a thickness, a front surface, and a back surface, said back surface disposed on said backing plate and said back surface comprising a plurality of concentric grooves, each of said grooves having a height, an inner surface, and an outer surface inclined at an incident angle; and compressing said frontal member onto said backing plate, wherein a resulting force between said outer surface of at least one of said grooves and said inner surface of at least one of said receiving channels results in a compressive preload onto said frontal member;

wherein said armor protection protects the host carrier from the impact of a projectile bullet.

* * * * *